US010323351B2

(12) United States Patent
Weiss et al.

(10) Patent No.: US 10,323,351 B2
(45) Date of Patent: Jun. 18, 2019

(54) METHOD FOR OPERATING A TUMBLE DRYER

(71) Applicant: E.G.O. Elektro-Geraetebau GmbH, Oberderdingen (DE)

(72) Inventors: Steffen Weiss, Zaisenhausen (DE); Kay Schmidt, Flehingen (DE); Pascal Hain, Eggenstein-Leopoldshafen (DE); Rebecca Grill, Oberderdingen (DE)

(73) Assignee: E.G.O. Elektro-Geraetebau GmbH, Oberderdingen (DE)

( * ) Notice: Subject to any disclaimer, the term of this patent is extended or adjusted under 35 U.S.C. 154(b) by 282 days.

(21) Appl. No.: 15/266,301

(22) Filed: Sep. 15, 2016

(65) Prior Publication Data

US 2017/0073880 A1 Mar. 16, 2017

(30) Foreign Application Priority Data

Sep. 15, 2015 (DE) ..... 10 2015 217 667

(51) Int. Cl.
*D06F 58/02* (2006.01)
*D06F 58/28* (2006.01)

(52) U.S. Cl.
CPC ..... *D06F 58/28* (2013.01); *D06F 58/02* (2013.01); *D06F 2058/289* (2013.01);
(Continued)

(58) Field of Classification Search
CPC .. D06F 58/28; D06F 58/02; D06F 2058/2819; D06F 2058/2829;
(Continued)

(56) References Cited

U.S. PATENT DOCUMENTS 6,493,963 B1 * 12/2002 England ..... D06F 58/28 34/491
6,757,988 B2 * 7/2004 Bruntz ..... D06F 58/28 219/492
(Continued)

FOREIGN PATENT DOCUMENTS

DE 4411958 A1 10/1995
DE 19629805 A1 1/1998
(Continued)

*Primary Examiner* — Stephen M Gravini
(74) *Attorney, Agent, or Firm* — Alston & Bird LLP

(57) ABSTRACT

In a method for operating a tumble dryer for drying damp laundry, the profile of the moisture of the air in the tumble dryer, advantageously the absolute moisture, is measured during an initial phase of the drying process. The profile of the measured moisture is then compared with stored profiles for the moisture or a gradient of the profile of the measured moisture is compared with stored gradient threshold values for gradient values of the moisture. In this case, profiles and/or gradient threshold values for fibers from the following group: cotton, wool and synthetic fibers, and also an upper gradient threshold value and a lower gradient threshold value are stored. A major fabric content including synthetic fibers is identified for the laundry when the upper gradient threshold value is exceeded, a major fabric content including wool is identified when the lower gradient threshold value is undershot, and a major fabric content including cotton is identified between the upper gradient threshold value and the lower gradient threshold value.

12 Claims, 1 Drawing Sheet

(52) U.S. Cl.
CPC ..... *D06F 2058/2819* (2013.01); *D06F 2058/2829* (2013.01); *D06F 2058/2861* (2013.01); *D06F 2058/2877* (2013.01); *D06F 2058/2896* (2013.01)

(58) Field of Classification Search
CPC ..... D06F 2058/2861; D06F 2058/2877; D06F 2058/289; D06F 2058/2896
USPC ..... 34/476
See application file for complete search history.

(56) References Cited

U.S. PATENT DOCUMENTS 7,665,227 B2 * 2/2010 Wright ..... D06F 25/00 34/339
7,765,716 B2 * 8/2010 Kim ..... D06F 58/04 134/1
7,941,937 B2 * 5/2011 Do ..... D06F 58/28 219/201
7,992,322 B2 * 8/2011 Kim ..... D06F 58/04 126/85 B
8,015,726 B2 * 9/2011 Carow ..... D06F 58/28 34/381
8,549,770 B2 * 10/2013 Bellinger ..... D06F 58/28 34/486
8,661,706 B2 * 3/2014 Bellinger ..... D06F 58/28 34/486
8,725,454 B2 * 5/2014 Prajescu ..... D06F 58/28 34/562
9,255,359 B2 * 2/2016 Altinier ..... D06F 58/28
9,580,860 B2 * 2/2017 Bellinger ..... D06F 58/28
9,850,621 B2 * 12/2017 Morin ..... D06F 58/28
2006/0150437 A1 * 7/2006 Tarnowski ..... D06F 58/28 34/443
2008/0104860 A1 5/2008 Muenzner et al.
2009/0313848 A1 12/2009 Moschütz et al.
2014/0115916 A1 * 5/2014 Altinier ..... D06F 58/203 34/282
2017/0073880 A1 * 3/2017 Weiss ..... D06F 58/02

FOREIGN PATENT DOCUMENTS

DE 102006037239 A1 2/2008
DE 102006053274 A1 5/2008
DE 102015217667 A1 * 3/2017 ..... D06F 58/02
EP 1916326 A1 10/2006
EP 2537975 A1 * 12/2012 ..... D06F 58/203
EP 2832918 A1 * 2/2015 ..... D06F 58/28
EP 3144425 A1 * 3/2017 ..... D06F 58/02
WO WO 2012175640 A1 * 12/2012 ..... D06F 58/203
WO WO 2015014608 A1 * 2/2015 ..... D06F 58/28

* cited by examiner

METHOD FOR OPERATING A TUMBLE DRYER

CROSS-REFERENCE TO RELATED APPLICATIONS

This application claims priority to German Application No. 10 2015 217 667.3, filed Sep. 15, 2015, the contents of which are hereby incorporated herein in its entirety by reference.

TECHNOLOGICAL FIELD

The invention relates to a method for operating a tumble dryer in order to thereby dry damp laundry. In particular, the invention relates to controlling the drying process as a function of identifying, in as largely an automated manner as possible, the major fabric content or the major fibres of the laundry to be dried.

BACKGROUND

US 2008/104860 A1 discloses measuring the absolute atmospheric moisture in the tumble dryer. The loading quantity, in particular as weight, and the residual moisture in the laundry can be determined from this. Therefore, the expected duration of the drying process can be determined and indicated to an operator.

BRIEF SUMMARY

The invention is based on the object of providing a method of the kind mentioned in the introductory part with which problems and disadvantages of the prior art can be avoided and it is possible, in particular, to provide a practical method with which the major fibre content of the laundry to be dried can be identified during operation of a tumble dryer for the purpose of adapting the operation of the tumble dryer, in particular in respect of temperature profile or maximum temperature. Sensitive fibres can be protected in this way.

This problem is solved by a method. Advantageous and preferred refinements of the invention are the subject matter of the further claims and will be explained in greater detail in the text which follows. The wording of the claims is included in the content of the description by express reference.

It is provided, for operation of the tumble dryer, that, after the start of the drying process for the damp laundry, which can start either at the same time or else can begin only after a few minutes, the moisture of the air in the tumble dryer or the time profile of the moisture of the air in the tumble dryer is detected or measured. In this case, the absolute moisture or atmospheric moisture can be measured, wherein a correspondingly suitable moisture sensor for absolute moisture measurement can be used for this purpose, as is disclosed, for example, in the above-mentioned document US 2008/104860 A1. As an alternative, the relative moisture in the air in the tumble dryer can also be measured using a corresponding moisture sensor. Moisture sensors of this kind for relative moisture measurement are now available at low cost and operate in a sufficiently accurate manner. The temperature of the air in the tumble dryer can advantageously additionally be detected over the course of time, in order to be able to in turn draw conclusions about the values for the required moisture in this way.

Measurement is performed primarily in the ascent region of the profile of the moisture or during an initial phase of the drying process. This can be, for example, during the first at most 10 minutes to 15 minutes, but rather at most 5 minutes. The measurement or detection can also advantageously start only after 1 to 3 minutes, in order to preclude inaccuracies which prevail at the very start.

In a subsequent step, the profile of the measured moisture is compared with stored profiles for the moisture over time. As an alternative, a gradient of the profile of the measured moisture, that is to say the gradient values of the moisture, can be compared with stored gradient threshold values of the moisture. This applies irrespective of whether the absolute moisture or the relative moisture is measured. In this case, corresponding profiles and/or gradient threshold values are stored, specifically for fibres from the group comprising cotton, wool and synthetic fibres. A synthetic fibre of this kind is primarily PE or polyamide. These profiles or gradient threshold values can be stored in a memory of a control system of the tumble dryer. Corresponding profiles, that is to say, as it were, curves which can be stored as a graph or effectively a complete continuous time profile, can be stored for the stored time profiles, for example for the first 10 minutes to 15 minutes. Simple values without a time profile can be stored for the gradient threshold values, for example as maximum gradient threshold values. As an alternative, the gradient threshold values are stored with a specific time, that is to say the time at which they are each typically exceeded or undershot, depending on the major fibre content or fabric content in the laundry to be dried. These gradient threshold values can lie, for example, at a point in time between 1 minute to 3 minutes and 10 minutes to 15 minutes, advantageously between 3 minutes and 10 minutes. This is also still the start of the drying process.

The greatest similarity can be identified during a comparison of the detected profile of the moisture in the tumble dryer with the three stored profiles, so that the major fabric content of the laundry to be dried is then associated with that fibre type of which the profile best corresponds to the detected time profile of the moisture. Deviations can be detected here directly or else, as it were, in an integrated manner, for example by means of the size of surface areas of a difference between the two profiles. In this case, both absolute values, for example maximum points or the connection points of the profile, and also relative values, such as percentage drop within a specific time, can be taken into consideration.

If, as an alternative, gradient values are compared at specific points in time, in particular during ascent, this is generally simpler and possibly even more accurate. If a stored upper gradient threshold value is exceeded, a major fabric content comprising synthetic fibres is identified for the laundry to be dried. If a stored low gradient threshold value is undershot, a major fabric content comprising wool or wool fibres is identified. If the detected gradient threshold value lies between the upper gradient threshold value and the lower gradient threshold value, a major fabric content comprising cotton or cotton fibres is identified. As stated, this can be done at a suitable point in time. In this alternative, it can be easily identified that evaluation or identification is easier. It is only necessary for the gradient value to be ascertained from the detected time profile of the moisture at a specific point in time, for example after 3 minutes to 10 minutes, this being straightforward. This detected gradient value is then compared with the stored gradient threshold values and the laundry to be dried is classified under one of the three categories.

The operation of the tumble dryer or the drying process can then be adapted on the basis of this. This applies, for example, for the temperature profile or a maximum temperature which is very important, in particular, for the synthetic fibres. Synthetic fibres must not be dried with too high a heat since otherwise they become brittle relatively quickly. The same also applies for wool, wherein here it is also the case that the rotation speed or the drum movement of the tumble dryer should be rather slow or gentle since wool is relatively sensitive. This is generally less important for cotton since cotton can be dried relatively easily at high temperatures and with pronounced drum movement.

The gradient threshold values can be stored not only as individual values at precisely one point in time, but rather also as a graph or as a time profile. In this case, it is also possible to attempt to detect the gradient values and to compare the gradient values with the stored gradient threshold values several times, that is to say at several points in time, and at prespecified times.

In addition to detecting the moisture in the tumble dryer, in particular the absolute moisture, the temperature in the tumble dryer can also be detected in terms of its time profile. Detection of the absolute moisture allows the temperature in the tumble dryer to be detected over the course of time, at least when at the start of the drying process, and then to determine the relative moisture from this. In this case, a temperature sensor and a moisture sensor can be formed separately from one another, in order to be able to use accurate and at the same time cost-effective sensors in each case.

As an alternative, the relative moisture in the tumble dryer can likewise be measured directly using a corresponding moisture sensor which is designed for relative moisture measurement. In this case, it is additionally also possible to detect the temperature of the air in the tumble dryer over the course of time by means of a temperature sensor, in order to obtain further information. In particular, the absolute moisture can then be calculated from this. In this case too, it should be possible to detect the temperature of the air in the tumble dryer, in addition to the moisture, at least at the start of the drying process.

If, on account of the comparison of the detected time profiles or the detected gradient values, the major fibre material of the laundry to be dried is identified, operation of the tumble dryer can likewise be matched to the major fibre material. This applies, in particular, for temperature profile, maximum temperature, drum movement, rotation speed and/or duration of the drying process. Therefore, on the one hand, damage to the fibres or to the laundry to be dried can be avoided. Secondly, the drying process can be carried out within the possible thresholds in a rapid and/or energy-efficient manner.

These and further features can be gathered from the claims as well as from the description and the drawings, wherein the individual features can each be implemented in their own right or in groups in the form of sub-combinations in the case of an embodiment of the invention and in other fields, and may represent advantageous and inherently patentable embodiments for which protection is claimed here. The subdivision of the application into individual sections and sub-headings does not restrict the general validity of the statements made therein.

BRIEF DESCRIPTION OF THE SEVERAL VIEWS OF THE DRAWINGS

Exemplary embodiments of the invention are schematically illustrated in the drawings and will be explained in greater detail in the text which follows. In the drawings.

DETAILED DESCRIPTION

Figure 1:
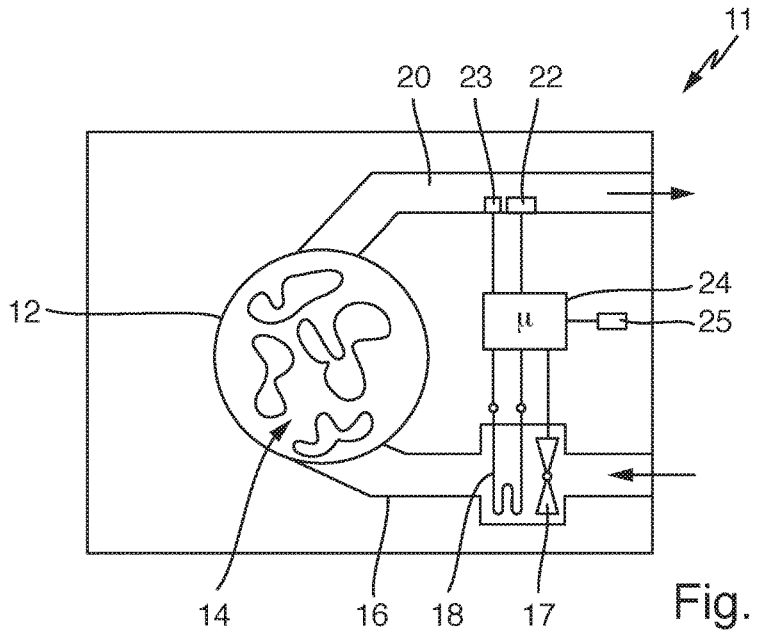
FIG. 1 shows an internal view of a tumble dryer.

FIG. 1 illustrates a tumble dryer 11 for the method according to the invention. The illustration is limited to the functionally important parts and is intended merely to show how these important parts function. Laundry 14 containing residual moisture after washing and/or spin-drying is located in a loading compartment 12. This loading compartment 12 is usually turned or rotated, but this does not play an important role for the invention. Air is introduced into the loading compartment 12 via an air inlet 16. The air flow is generated by the fan 17, wherein air is heated by the downstream heater 18 in order to dry the laundry 14. Similarly, an air outlet 20 is routed out of the loading compartment 12 to the outside, this identifying the tumble dryer 11 as an exhaust-air tumble dryer. As is known of tumble dryers of this kind, the hot air is therefore supplied to the laundry 14, absorbs moisture and transports the moisture via the air outlet 20 to the outside, in order to dry the laundry in this way.

In order to detect the moisture in the exhaust air, a moisture sensor 22 is arranged in the air outlet 20. A moisture sensor 22 of this kind is known to a person skilled in the art and does not need to be explained in any detail here. The moisture sensor 22 is connected to a control system 24, just like the fan 17 and the heater 18. The control system 24 has a memory 25, possibly even integrated in it, in which various values or profiles can be stored, this being discussed in further detail below.

In addition to the moisture sensor 22, a temperature sensor 23 which is likewise connected to the control system 24 is arranged in the air outlet 20. The temperature sensor is advantageously a customary temperature sensor, particularly advantageously with resistance measurement. The moisture sensor 22 can advantageously be designed to measure the absolute moisture, that is to say the moisture of the exhaust air in the air outlet 20. As an alternative, the moisture sensor can also be a moisture sensor for relative moisture measurement, which may be more cost-effective. In order to then obtain the absolute moisture of the air in the air outlet 20, the temperature sensor 23 is provided in the air outlet 20. In this case, the temperature sensor is arranged just in front of the moisture sensor 22, but can also be arranged opposite or just behind the moisture sensor. A tumble dryer of this kind is substantially known from US 2008/104860 A1 which is cited in the introductory part and to which reference is explicitly made in this respect.

Apart from for an exhaust-air tumble dryer 11 illustrated in FIG. 1, the invention can also be used in modified form for a condensation tumble dryer. To this end, a corresponding moisture sensor is provided in an air outlet from the loading compartment in front of a downstream condensation device. Therefore, the moisture in the exhaust air can also be detected there.

Figure 2:
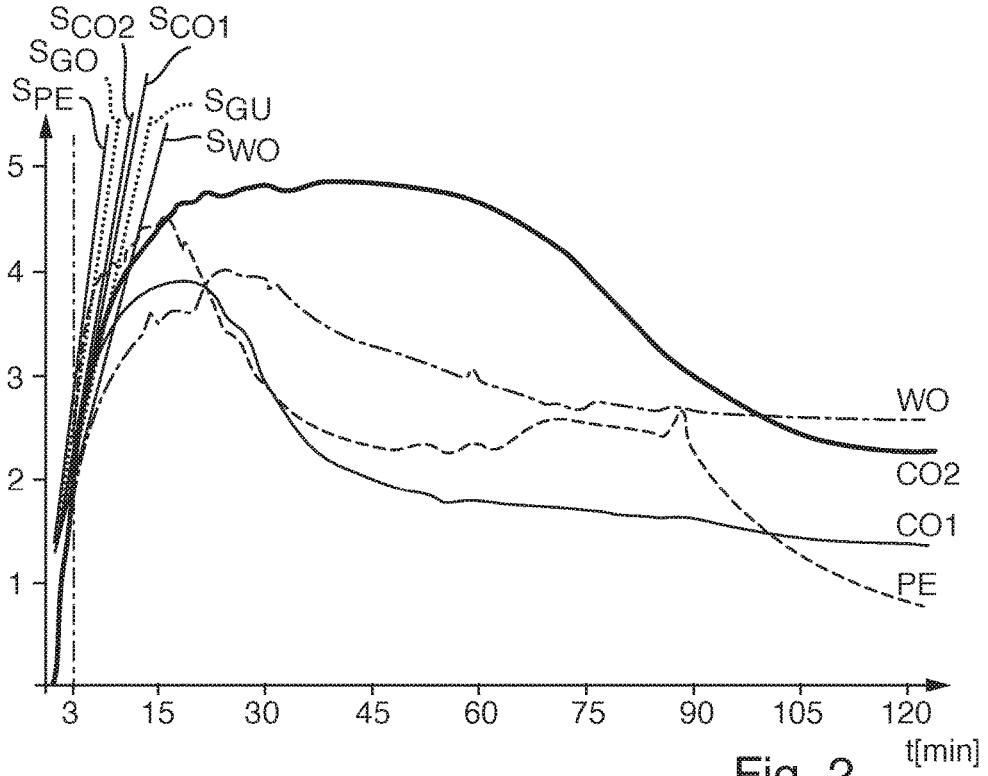
FIG. 2 shows a graph for various profiles of the moisture over time in the case of loading with laundry comprising different fibres for the tumble dryer according to FIG. 1.

It is not necessary to explain the general manner of operation of a tumble dryer here. According to the invention, after the laundry 14 is introduced into the tumble dryer 11, that is the loading compartment 12 of the tumble dryer, the drying process is started with operation of the fan 17 and of the heater 18 in order to heat the air. In this case, the absolute moisture is detected in the air outlet 20 by means of the moisture sensor 22 over the course of time in this exemplary embodiment. The curves for the absolute moisture are firstly known from the above-mentioned document US 2008/104860 A1 and illustrated once again in FIG. 2. The figure illustrates four different profiles, specifically a solid thin profile CO1 for a quantity of 1.2 kg of exclusively cotton fibre laundry with a residual moisture content of 40%. The solid thick profile CO2 shows a quantity of 4.5 kg of cotton fibre laundry with a moisture content of 50%. The dashed thin profile PE shows a quantity of 1.2 kg of polyester fibre laundry and a moisture content of 40%. The thin dash-dotted profile WO shows a quantity of 1.2 kg of wool laundry with a moisture content of 40%. The ascent region cited in the introductory part or the beginning of the drying process is considered to be the first minutes here, specifically at most measured for the first 15 minutes, advantageously for the first 3 minutes to 10 minutes. In this case, it can be seen in this ascent region that the profile is indeed similar but has a different gradient depending on the type of fibres of the laundry, as a result of which different profiles are of course also produced. The profile PE for the synthetic fibre, that is to say polyester, has the highest gradient at the start. As expected, WO for wool has the lowest gradient. The two profiles CO1 and CO2 for cotton are situated in-between, wherein, as expected, the profile for the greater quantity of damper cotton as profile CO2 is steeper and rises more sharply than for the lower quantity of cotton as profile C01.

The gradient values of the profiles after 3 minutes are marked by way of example. At this point in time, the profile PE has the greatest gradient with the gradient value $S_{PE}$, and the profile WO has the lowest gradient with the gradient value $S_{WO}$. The gradient values are illustrated by the corresponding straight lines here. The two gradient values for the profiles CO1 and CO2 with the gradient value $S_{CO1}$ and with the gradient value $S_{CO2}$ are situated between the first gradient values. If these gradient values, which have been detected by the moisture sensor 22, at the 3-minute point in time are then compared with gradient threshold values, which are stored in the memory 25, a slight distinction can be drawn as follows. A stored upper gradient threshold value $S_{GO}$, which is illustrated using a dotted line, is situated between the gradient values of the profiles PE and CO2. A stored lower gradient threshold value $S_{GU}$, which is also illustrated using a dotted line, can be situated between the gradient values of the profiles CO1 and WO. Depending on whether the upper gradient threshold value $S_{GO}$ is exceeded or undershot and the lower gradient threshold value $S_{GU}$ is exceeded or undershot at this point in time of t=3 minutes, the laundry can be divided into the fibre groups PE, CO or WO, that is to say synthetic fibres, cotton or wool. Whether the present gradient value is actually exactly detected is of secondary importance, provided that the measurement is accurate enough to be able to safely and reliably and accurately establish that one of the gradient threshold values has been exceeded or undershot. Even if the differences in the gradient values in FIG. 2 do not appear to be particularly significant, they are significant from a computational point of view. For example, the gradient value $S_{PE}$ is approximately 25% greater than the gradient threshold value $S_{GO}$, even though it does not appear to be.

Measurement relatively early after the start of the drying process or in the initial phase of the drying process, that is to say after the 3 minutes for example, not only has the advantage that identification of the exclusive or major fabric content is then possible at a very early stage, in order to select a maximum temperature to be relatively low and possibly also to select a rotation speed to be low for example in the case of sensitive fibres, such as synthetic fibres or wool, so that damage can be avoided. Furthermore, the ascents are further particularly different here, so that even particularly good identification or distinguishing of the respective gradient values is possible. At point in time t=10 minutes, it would no longer be possible to draw a distinction as well or actually even at all.

As an alternative to the above-described detection of gradient values at an early point in time, it is also possible for specific profiles to be stored in the memory 25 of the control system 24. These specific profiles are distinguished in a characteristic manner, for example the very slow drop in moisture after reaching the maximum value in the case of wool since moisture can be drawn from wool only with difficulty. In contrast, the synthetic fibre is very pronounced in respect of the maximum value and the speed of the drop since, as is known, moisture can be drawn from synthetic fibres much more quickly. The profiles for cotton are situated approximately between those for wool and synthetic fibres. Therefore, these basic profiles or types of profile could also be stored and a conclusion about the major fabric content in the laundry 14 could be drawn by comparing a profile, which is detected over time, of the atmospheric moisture in the air outlet 20 with a stored profile. However, to this end, it would be necessary to wait at least for the maximum value to be reached and for a subsequent drop. However, this firstly means a certain waiting time until identification. Secondly, the relatively sensitive synthetic fibres or wool may possibly already be damaged in the case of drying of the laundry 14 at a very high temperature. In this respect, comparing the gradient values is considered to be the most advantageous option because it is also very quick.

That which is claimed:

1. A method for operating a tumble dryer for drying damp laundry, comprising the following steps:

after a start of a drying process for said damp laundry in said tumble dryer, a profile of moisture of air in said tumble dryer is measured, wherein measurement is performed in an ascent region of said profile of said moisture or during an initial phase of said drying process, in a following step, said profile of said measured moisture is compared with stored profiles for moisture or a gradient of said profile of said measured moisture is compared with stored gradient threshold values for moisture, wherein profiles or gradient threshold values are stored for fibres from the following group: cotton, wool and synthetic fibres, wherein an upper gradient threshold value and a lower gradient threshold value are stored, wherein a major fabric content comprising synthetic fibres is identified when said upper gradient threshold value for said laundry is exceeded, a major fabric content comprising wool is identified when said lower gradient threshold value is undershot, and a major fabric content comprising cotton is identified between said upper gradient threshold value and said lower gradient threshold value.

2. Method according to claim 1, wherein said gradient threshold values are stored in a form of a graph or as a time profile.

3. Method according to claim 1, wherein said gradient threshold values are stored as purely numerical values.

4. Method according to claim 3, wherein said gradient threshold values are stored as purely numerical values at a specific point in time.

5. Method according to claim 1, wherein an absolute moisture in said tumble dryer is measured using a moisture sensor.

6. Method according to claim 1, wherein said temperature of air in said tumble dryer is detected over a course of time.

7. Method according to claim 6, wherein the temperature of the air in the tumble dryer is detected over a course of time at least at a beginning of said drying process.

8. Method according to claim 1, wherein said relative moisture in said air in said tumble dryer is measured using a corresponding moisture sensor for relative moisture measurement.

9. Method according to claim 8, wherein a temperature of air in said tumble dryer is additionally detected over a course of time.

10. Method according to claim 9, wherein said temperature of air in said tumble dryer is additionally detected over a course of time at least at a beginning of said drying process.

11. Method according to claim 1, wherein an operation of said tumble dryer is matched to a material of said identified fibres in respect of temperature profile, maximum temperature, drum movement, rotation speed or duration of said drying process.

12. Method according to claim 11, wherein said operation of said tumble dryer is with a lower maximum temperature for synthetic fibres and wool.

* * * * *